US008543387B2

(12) United States Patent
Goto et al.

(10) Patent No.: US 8,543,387 B2
(45) Date of Patent: Sep. 24, 2013

(54) ESTIMATING PITCH BY MODELING AUDIO AS A WEIGHTED MIXTURE OF TONE MODELS FOR HARMONIC STRUCTURES

(75) Inventors: Masataka Goto, Tsukuba (JP); Takuya Fujishima, Hamamatsu (JP); Keita Arimoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1278 days.

(21) Appl. No.: 11/849,217

(22) Filed: Aug. 31, 2007

(65) Prior Publication Data

US 2008/0262836 A1 Oct. 23, 2008

(30) Foreign Application Priority Data

Sep. 4, 2006 (JP) ..... 2006-238778

(51) Int. Cl.
*G10L 11/04* (2006.01)
*G10L 19/14* (2006.01)
*G10L 19/00* (2013.01)

(52) U.S. Cl.
USPC ..... 704/207; 704/205; 704/200.1

(58) Field of Classification Search
None
See application file for complete search history.

(56) References Cited

U.S. PATENT DOCUMENTS 6,140,568 A 10/2000 Kohler
6,188,979 B1 * 2/2001 Ashley ..... 704/205
6,418,407 B1 * 7/2002 Huang et al. ..... 704/207
2001/0045153 A1 11/2001 Alexander et al.
2004/0158462 A1 * 8/2004 Rutledge et al. ..... 704/207

FOREIGN PATENT DOCUMENTS

JP 3413634 4/2003
WO WO-2005/066927 A1 7/2005
WO WO-2006/106946 10/2006

OTHER PUBLICATIONS

Kameoka et al. "Separation of Harmonic Structures Based on Tied Gaussian Mixture Model and Information Criterion for Concurrent Sounds," in International Conference on Acoustics, Speech, and Signal Processing, IEEE ICASSP, Montreal, Canada, 2004.*
Marolt, Matija. "Gaussian Mixture Models for Extraction of Melodic Lines from Audio Recordings". In Proc. Int. Conf. Music Information Retrieval, Barcelona, Spain, 2004, pp. 80-83.*
Goto, M. (May 7, 2001). "A Predominant-F0 Estimation Method for CD Recordings: MAP Estimation Using EM Algorithm for Adaptive Tone Models," *IEEE International Conference on Acoustics, Speech and Signal Processing Proceedings*, May 7-11, New York, NY, 1:3365-3368.
Goto, Masataka, A Robust Predominatn-F0 Estimation Method for Real Time Detection of Melody and Bass Lines in CD Recordings, Proceedings IEEE ICASSP 2000 [Online] vol. 2, pp. 757-760, Jun. 9, 2000.

(Continued)

*Primary Examiner* — Jesse Pullias
(74) *Attorney, Agent, or Firm* — Morrison & Foerster LLP

(57) ABSTRACT

Disclosed herein is a pitch estimation apparatus and associated methods for estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models.

5 Claims, 5 Drawing Sheets

(56) References Cited

OTHER PUBLICATIONS

Goto, Masataka, A Real-time Music Scene Description System: Predominant-F0 Estimation for Detecting Melody and Bass Lines on Real World Audio Signals, Speech Communication, Elsevier Science Publishers, Amsterdam, NL, vol. 43, No. 4, pp. 311-329, Sep. 2004.

Kitahara, Tetsuro et al., Musical Instrument Identification Based on F0-Dependent Multivariate Normal Distribution, Multimedia and Expo, 2003 Proceedings, 2003 International Conference, Jul. 6-9, 2003, Piscataway, NJ, vol. 6, pp. 409-412.

Goto, M., "A Real-Time Music-Scene-Description System: Predominant-F0 Estimation for Detecting Melody and Bass Lines in Real-World Audio Signals", Speech Communication, 43, 2004, pp. 311-329.

* cited by examiner

ESTIMATING PITCH BY MODELING AUDIO AS A WEIGHTED MIXTURE OF TONE MODELS FOR HARMONIC STRUCTURES

BACKGROUND OF THE INVENTION

1. Technical Field of the Invention

The present invention relates to a technology for estimating a pitch (fundamental frequency) of music sounds.

2. Description of the Related Art

A technology for estimating the fundamental frequency of a desired sound (tone) included in music sounds (which will be referred to as a target sound) is described in Japanese Patent Registration No. 3413634. In this technology, an amplitude spectrum or power spectrum of a target sound is modeled as a mixed distribution of a plurality of tone models, each of which is a probability density function modeling a harmonic structure, and a distribution of respective weights of the plurality of tone models is interpreted as a fundamental frequency probability density function, and a salient peak prominent in the probability density function is estimated as the pitch of the target sound.

However, a number of peaks appear in the fundamental frequency probability density function at fundamental frequencies other than the fundamental frequency of the desired sound. For example, peaks in an amplitude spectrum of a sound whose fundamental frequency is 100 Hz overlap at the harmonic frequencies (200 Hz, 400 Hz, 600 Hz, 800 Hz, . . . ) with peaks of another amplitude spectrum of another sound whose fundamental frequency is 200 Hz. Thus, when a sound whose fundamental frequency is 200 Hz is included in a target sound, a salient peak appears not only at 200 Hz but also at 100 Hz in its fundamental frequency probability density function even though no sound of a fundamental frequency of 100 Hz is actually included in the target sound. In addition, when the target sound is a mixture of a number of sounds, prominent peaks corresponding to fundamental frequency and harmonic components of the sounds appear in the fundamental frequency probability density function. It is difficult to accurately extract only the fundamental frequency of a desired sound from such a probability density function which includes a number of salient peaks.

SUMMARY OF THE INVENTION

The present invention has been made in view of the above circumstances and it is an object of the present invention to accurately estimate the fundamental frequency of an audio signal, particularly containing a mixture of a plurality of sounds).

In order to achieve the object, the present invention provides a pitch estimation apparatus for estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models. The pitch estimation apparatus comprises: a function estimation part that estimates the fundamental frequency probability density function by repeating a weight calculation process and an estimated shape specification process, wherein the weight calculation process calculates a weight of each tone model of each fundamental frequency based on an estimated shape of each tone model of each fundamental frequency, the estimated shape indicating a degree of dominancy of a corresponding tone model in a total harmonic structure of the audio signal, and the estimated shape specification process specifies each estimated shape of each tone model of each fundamental frequency based on an amplitude spectrum of the audio signal, the harmonic structure of each tone model of each fundamental frequency, and the weight of each tone model of each fundamental frequency; a similarity analysis part that calculates a similarity index value indicating a degree of similarity between each tone model of each fundamental frequency and each estimated shape specified from the corresponding tone model in the estimated shape specification process; and a weight correction part that reduces a weight of at least one tone model of a certain fundamental frequency having the similarity index value indicating that the one tone model and the corresponding estimated shape are not similar to each other, among the weights of the plurality of the tone models calculated in the weight calculation process.

This configuration suppresses a weight of a fundamental frequency, whose tone model and corresponding estimated shape are not similar, among the plurality of weights calculated in the weight calculation process, thereby reducing the possibility that a ghost peak will occur in the fundamental frequency probability density function due to a tone model that deviates from the total harmonic structure of the audio signal. This makes it possible to accurately extract fundamental frequencies of an audio signal (i.e., pitches of target sounds).

In a preferred embodiment of the present invention, the weight correction part changes the weight of the one tone model of the certain fundamental frequency to zero, the one tone model of the certain fundamental frequency having the similarity index value indicating that the one tone model and the corresponding estimated shape are not similar to each other. This embodiment changes, to zero, a weight of a fundamental frequency, whose tone model and corresponding estimated shape are not similar, thereby absolutely suppressing a peak in the fundamental frequency probability density function caused by a tone model that deviates from the total harmonic structure of the target sound. This makes it possible to more accurately extract fundamental frequencies of the audio signal.

In the configuration illustrated above, the weight correction part reduces a weight of a fundamental frequency, whose similarity index value indicates that a tone model and an estimated shape corresponding to the fundamental frequency are not similar. However, the present invention may also provide a configuration in which the weight correction part increases a weight of a fundamental frequency, whose similarity index value calculated by the similarity analysis part indicates that a tone model and an estimated shape corresponding to the fundamental frequency are similar, among a plurality of weights calculated in the weight calculation process.

In a preferred embodiment of the present invention, the function estimation part executes the estimated shape specification process to generate the estimated shape of the corresponding tone model of the respective fundamental frequency based on a product of the amplitude spectrum of the audio signal, the harmonic structure of the corresponding tone model, and the weight calculated for the corresponding tone model of the respective fundamental frequency. This embodiment has advantages in that the estimated shape is generated through a simple calculation, and the similarity between the total harmonic structure of the audio signal and the harmonic structure of the tone model is remarkably reflected in the estimated shape.

When an audio signal including a plurality of sounds is processed, a fundamental frequency of a desired sound could be estimated, for example by searching for a salient peak with the highest weight in the fundamental frequency probability density function, even if two or more peaks are present in the probability density function at ghost fundamental frequencies that are not actually included in the audio signal. However, in the case where fundamental frequencies of a plurality of sounds are estimated from an audio signal, such a highest weight search method could not be used so that it is difficult to accurately determine whether or not peaks in the fundamental frequency probability density function correspond to fundamental frequencies that are actually included in the audio signal. According to the present invention, peaks at fundamental frequencies, which are not actually included in the audio signal, are suppressed in the fundamental frequency probability density function so that it is possible to accurately estimate fundamental frequencies of a plurality of sounds from the fundamental frequency probability density function. That is, the present invention is desirably applied to a pitch estimation apparatus that includes a pitch specifying part for specifying, as pitches, a plurality of fundamental frequencies corresponding to peaks in the fundamental frequency probability density function estimated by the function estimation part.

The present invention is also specified as a method for estimating a fundamental frequency of an audio signal. Thus, the present invention provides a pitch estimation method of estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models. The pitch estimation method comprises: estimating the fundamental frequency probability density function by repeating a weight calculation process (for example, a process of a weight calculator 23 in FIG. 1) and an estimated shape specification process (for example, a process of an estimated shape specifier 21 in FIG. 1), wherein the weight calculation process calculates a weight of each tone model of each fundamental frequency based on an estimated shape of each tone model of each fundamental frequency, the estimated shape indicating a degree of dominancy of a corresponding tone model in a total harmonic structure of the audio signal, and the estimated shape specification process specifies each estimated shape of each tone model of each fundamental frequency based on an amplitude spectrum of the audio signal, the harmonic structure of each tone model of each fundamental frequency, and the weight of each tone model of each fundamental frequency; calculating a similarity index value (for example, a process of a similarity analyzer 271 in FIG. 1) indicating a degree of similarity between each tone model of each fundamental frequency and each estimated shape specified from the corresponding tone model in the estimated shape specification process; and reducing a weight of at least one tone model of a certain fundamental frequency (for example, a process of a weight corrector 273 in FIG. 1) having the similarity index value indicating that the one tone model and the corresponding estimated shape are not similar to each other, among the weights of the plurality of the tone models calculated in the weight calculation process.

The pitch estimation apparatus according to the present invention is implemented by hardware (electronic circuitry) such as a Digital Signal Processor (DSP) dedicated to each process and is also implemented through cooperation between a program and a general-purpose processing unit such as a Central Processing Unit (CPU). In order to estimate a fundamental frequency of an audio signal from a fundamental frequency probability density function that is a distribution of respective weights of a plurality of tone models corresponding respectively to harmonic structures of individual fundamental frequencies when the audio signal is modeled as a mixed distribution of the plurality of tone models, a program according to the present invention causes a computer to perform a function estimation process that estimates the fundamental frequency probability density function by repeating a weight calculation process and an estimated shape specification process, wherein the weight calculation process calculates a weight of each fundamental frequency based on an estimated shape of a tone model of the fundamental frequency, the estimated shape representing an extent to which the tone model of the individual fundamental frequency supports or contributes a total harmonic structure of the audio signal, and the estimated shape specification process specifies an estimated shape of each fundamental frequency based on an amplitude spectrum of the audio signal, a tone model of the fundamental frequency, and a weight of the fundamental frequency; a similarity analysis process that calculates a similarity index value of each fundamental frequency indicating whether or not a tone model of the fundamental frequency and an estimated shape specified from the tone model in the estimated shape specification process are similar; and a weight correction process that reduces a weight of a fundamental frequency, whose similarity index value calculated in the similarity analysis process indicates that a tone model and an estimated shape corresponding to the fundamental frequency are not similar, among a plurality of weights calculated in the weight calculation process. The program of the present invention has the same operations and advantages as those of the pitch estimation apparatus according to the present invention. The program of the present invention is provided to a user in a form stored in a machine readable medium or portable recording medium such as a CD-ROM and then installed on the computer and is also provided from a server apparatus in a distributed manner over a network and then installed on the computer.

DETAILED DESCRIPTION OF THE INVENTION

Figure 1:
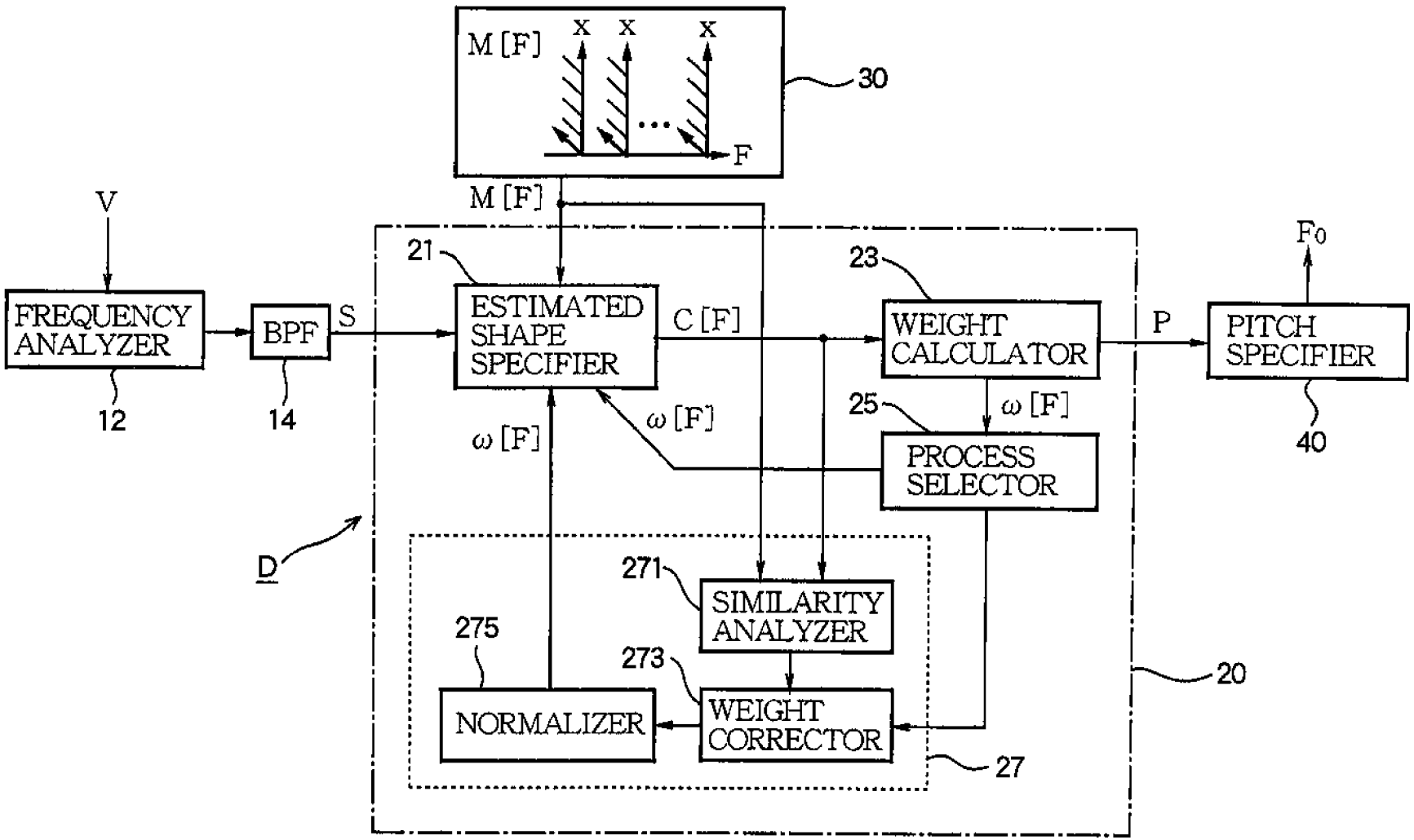
FIG. 1 is a functional block diagram illustrating a pitch estimation apparatus according to an embodiment of the present invention.

FIG. 1 is a functional block diagram illustrating a pitch estimation apparatus according to an embodiment of the present invention. A pitch estimation apparatus D is an apparatus that estimates fundamental frequencies (pitches) of sounds included in a target audio signal. As shown in FIG. 1, the pitch estimation apparatus D includes a frequency analyzer 12, a band pass filter (BPF) 14, a function estimator 20, a storage 30, and a pitch specifier 40. The components shown in FIG. 1 may each be implemented, for example, as a program executed by a processing unit such as a CPU and may also be implemented by hardware such as a Digital Signal Processor (DSP) dedicated to pitch estimation.

An audio signal V representing a time waveform of the target sound is input to the frequency analyzer 12. The target sound representing the audio signal V of this embodiment is a mixture of a plurality of sounds of different pitches or sound sources. The frequency analyzer 12 specifies an amplitude spectrum of the target sound by dividing the audio signal V into a number of frames using a specific window function and then performing frequency analysis including a Fast Fourier Transform (FFT) process on each frame of the audio signal V. The frames are set so as to overlap each other on the time axis.

The BPF 14 selectively passes components included in a specific frequency band in the amplitude spectrum specified by the frequency analyzer 12. The passband of the BPF 14 is previously selected statistically or empirically such that the BPF passes most of the fundamental frequency and harmonic components of sounds, whose pitches are to be estimated, among the plurality of sounds included in the target sound and blocks frequency bands in which fundamental frequency and harmonic components of other sounds are predominant over those of the desired sounds. An amplitude spectrum S that has passed through the BPF 14 is output to the function estimator 20.

Figure 2:
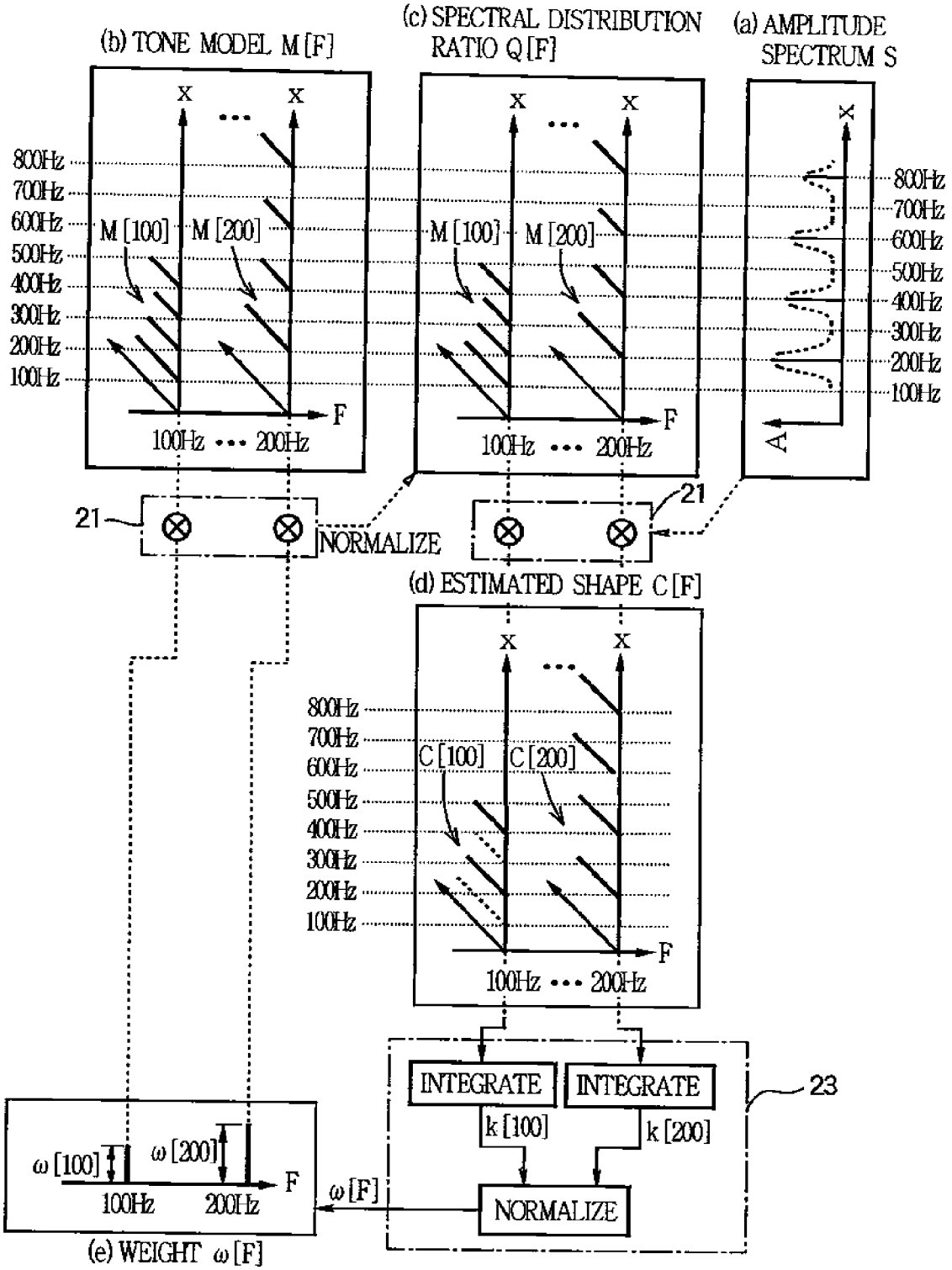
FIG. 2 is a conceptual diagram illustrating details of a unit process performed by a function estimator.

FIG. 2 is conceptual diagrams illustrating the overview of processes performed by the function estimator 20. Indeed, the amplitude spectrum S is distributed continuously with respect to frequency x as shown by a dotted line in FIG. 2(*a*). However, for ease of explanation, FIG. 2(*a*) shows the amplitude spectrum S with a plurality of lines (specifically, line segments with lengths corresponding to the strengths (amplitudes A) of peaks) which are arranged at respective frequencies x of the peaks. The same is true for notations of FIGS. 2(*b*) to 2(*e*) (specifically, tone model M[F] of FIG. 2(*b*), spectral distribution ratio Q[F] of FIG. 2(*c*), estimated shape C[F] of FIG. 2(*d*), and weight ω[F] of FIG. 2(*e*)). Although FIG. 2(*a*) shows the amplitude spectrum S of a target sound whose fundamental frequency F is 200 Hz (i.e., a target sound whose harmonic frequencies are 400 Hz, 600 Hz, 800 Hz) for the sake of convenience, the target sound is indeed a mixture of a plurality of sounds.

The function estimator 20 of FIG. 1 estimates a fundamental frequency probability density function P of the amplitude spectrum S. The fundamental frequency probability density function P is a function that expresses a distribution of weights ω[F] of a plurality of tone models M[F] when the amplitude spectrum S is modeled as a mixed distribution (or a weighted sum) of the tone models M[F].

The storage 30 is means for storing, as templates, the plurality of tone models M[F] used in the function estimator 20, examples of which include a magnetic storage device and a semiconductor storage device. As shown in FIG. 2(*b*) and FIG. 1, the tone model M[F] is prepared for each fundamental frequency F that is a candidate fundamental frequency F0 of each of the sounds included in the target sound. However, FIG. 2(*b*) merely shows a tone model M[100] corresponding to a fundamental frequency F of 100 Hz and a tone model M[200] corresponding to a fundamental frequency F of 200 Hz for the sake of convenience. The tone model M[F] is a function (probability density function) which models a harmonic structure (fundamental frequency and harmonic components) corresponding to the fundamental frequency F with respect to frequency x. For example, peaks appear in the tone model M[100] at a frequency x (x=100 Hz) corresponding to the fundamental frequency F and at frequencies x (x=200 Hz, 300 Hz, 400 Hz) corresponding to its harmonics as shown in FIG. 2(*b*). Accordingly, a weight ω[F] corresponding to a specific fundamental frequency F indicates the extent to which a harmonic structure modeled by a tone model M[F] corresponding to the fundamental frequency F is dominant in the amplitude spectrum S. As can be understood from the above definitions, fundamental frequencies at which prominent peaks appear in the probability density function P are likely to be fundamental frequencies F0 (pitches) of the sounds included in the target sound.

As shown in FIG. 1, the function estimator 20 includes an estimated shape specifier 21, a weight calculator 23, a process selector 25, and a ghost suppressor 27. The estimated shape specifier 21 is means for generating an estimated shape C[F] shown in FIG. 2(*d*) for each tone model M[F] (for each fundamental frequency F). The estimated shape specifier 21 of this embodiment generates a spectral distribution ratio Q[F] shown in FIG. 2(*c*) from each tone model M[F] and generates an estimated shape C[F] by multiplying the spectral distribution ratio Q[F] of each fundamental frequency F by the amplitude spectrum S. An estimated shape C[F] generated from one tone model M[F] through the spectral distribution ratio Q[F] is a function that represents, with respect to frequency x, a distribution of the extent to which the tone model M[F] supports (or contributes to) the harmonic structure of the audio signal V. The following is a detailed description of the relation between the tone model M[F] and the estimated shape C[F].

First, a peak appears in the estimated shape C at each frequency at which a peak appears in both the tone model M[F] and the amplitude spectrum S. For example, peaks appear in both the amplitude spectrum S of FIG. 2(*a*) and the tone model M[100] of FIG. 2(*b*) at frequencies x of 200 Hz and 400 Hz. Accordingly, peaks appear in an estimated shape C[100] at frequencies x of 200 Hz and 400 Hz as shown in FIG. 2(*d*). In addition, peaks appear in an estimated shape C[200] at frequencies x of 200 Hz, 400 Hz, 600 Hz, and 800 Hz since peaks appear in both the amplitude spectrum S and the tone model M[200] at frequencies x of 200 Hz, 400 Hz, 600 Hz, and 800 Hz.

On the other hand, no peak appears in the estimated shape C[F] at a frequency x corresponding to a peak in the tone model M[F] if the amplitude spectrum S has no peak at the frequency x. For example, while peaks appear in the tone model M[100] of FIG. 2(*b*) at frequencies x of 100 Hz and 300 Hz, no peaks appear in the amplitude spectrum A of FIG. 2(*a*) at frequencies x of 100 Hz and 300 Hz. Accordingly, no peaks appear in the estimated shape C[100] at frequencies x of 100 Hz and 300 Hz as shown by dotted lines in FIG. 2(*d*). As can be understood from the above description, an estimated shape C[F] has a larger number of and stronger peaks as a tone model M[F], from which the estimated shape C[F] is generated, more dominantly supports the shape (fundamental frequency and harmonic components) of the amplitude spectrum S (i.e., as the tone model M[F] has a distribution (peaks) closer to the harmonic structure of the amplitude spectrum S).

The weight calculator 23 is means for calculating a weight ω[F] of each fundamental frequency F from each estimated shape C[F] calculated by the estimated shape specifier 21. As shown in FIG. 2, first, the weight calculator 23 of this embodiment calculates a value k[F] (the integral of an estimated shape C[F] with respect to frequency x) of each fundamental frequency F by adding up the function values of the estimated shape C[F] of the fundamental frequency F at all frequencies x. The weight calculator 23 then generates a weight ω[F] of each fundamental frequency F by normalizing the value k[F] such that the sum of the weights ω[E] of all fundamental frequencies F is 1. That is, the weight ω[F] is expressed by k[F]/K when K is the sum of the values k[F] of all fundamental frequencies F.

The process selector 25 of FIG. 1 is means for selecting one of the processes of the estimated shape specifier 21 and the ghost suppressor 27 to which the weight ω[F] calculated by the weight calculator 23 is to be provided. The weight ω[F] calculated by the weight calculator 23 is output to the estimated shape specifier 21 if the process selector 25 selects the process of the estimated shape specifier 21 and is output to the estimated shape specifier 21 through the process of the ghost suppressor 27 if the process selector 25 selects the process of the ghost suppressor 27.

As shown in FIG. 2, the estimated shape specifier 21 generates a spectral distribution ratio Q[F] by multiplying the tone model M[F] read from the storage 30 by the weight ω[F] provided from the process selector 25 or the ghost suppressor 27. More specifically, the estimated shape specifier 21 generates spectral distribution ratios Q[F] by multiplying the tone models M[F] by the respective weights ω[F] and normalizing the multiplied tone models M[F] such that the sum of the amplitudes of the multiplied tone models M[F] at the same frequency x is 1. The estimated shape specifier 21 also generates an estimated shape C[F] of each fundamental frequency F by multiplying the amplitude spectrum S by the spectral distribution ratio Q[F] of the fundamental frequency F.

A unit process including the process for specifying the estimated shape C[F] at the estimated shape specifier 21 (hereinafter referred to as an "estimated shape specification process") and the process for specifying the weight ω[F] at the weight calculator 23 (hereinafter referred to as a "weight calculation process") is repeated a plurality of times (EM algorithm). Each unit process makes the weights ω[F] closer to respective weights of a plurality of tone models M[F] when the amplitude spectrum S is modeled as a mixed distribution of the plurality of tone models M[F].

At a stage immediately after one frame of the audio signal V is started to be processed, the weight calculator 23 has not yet calculated the weight ω[F] and thus the estimated shape specifier 21 calculates an estimated shape C[F] by multiplying the amplitude spectrum S by the tone model M[F] (i.e., by the spectral distribution ratio Q[F]). The process selector 25 outputs the weight ω[F] initially calculated for one frame to the ghost suppressor 27 while outputting subsequently calculated weights ω[F] to the estimated shape specifier 21. Accordingly, in the first estimated shape specification process after one frame of the audio signal V is started to be processed, the estimated shape C[F] is calculated by multiplying the amplitude spectrum S by the tone model M[F] and, in the second estimated shape specification process, the estimated shape C[F] is calculated by multiplying the amplitude spectrum S by the spectral distribution ratio Q[F] generated from both the tone model M[F] and a weight ω[F] that has been processed by the ghost suppressor 27. In the third and subsequent estimated shape specification processes, the estimated shape C[F] is calculated by multiplying the amplitude spectrum S by the spectral distribution ratio Q[F] generated from both the tone model M[F] and a weight ω[F] calculated by the weight calculator 23 (i.e., a weight ω[F] that has not been processed by the ghost suppressor 27). The weight calculator 23 outputs a distribution of weights ω[F] calculated when the number of repetitions of the unit process has reached a predetermined number, as a fundamental frequency probability density function P, to the pitch specifier 40.

However, when the fundamental frequency F of the amplitude spectrum S is 200 Hz as shown in FIG. 2(*a*), not only the tone model M[200] but also the tone model M[100] include peaks at the same frequencies x (200 Hz, 400 Hz) as those of the amplitude spectrum S. Accordingly, in a configuration in which the estimated shape specification process and the weight calculation process are merely repeated, a salient peak appears in the weight ω[F] not only at a fundamental frequency F of 200 Hz which is the fundamental frequency F of the amplitude spectrum S but also at a fundamental frequency F of 100 Hz which is not actually included in the audio signal V as shown in FIG. 2(*e*). A peak that appears in the weight ω[F] at a fundamental frequency F that is not actually included in the audio signal V will now be referred to as a "ghost".

It is difficult to accurately remove only the ghost from a plurality of peaks in the fundamental frequency probability density function P. Another problem is that a weight ω[F] of the fundamental frequency F of a sound that is actually included in the target sound is limited (i.e., an increase in the weight ω[F] is restricted) by as much as the amplitude of the ghost since the weight ω[F] is determined such that the integral of the weight ω[F] over all fundamental frequencies F is 1. The ghost causes a reduction in the accuracy of pitch specification as described above. Thus, in this embodiment, the ghost suppressor 27 suppresses the ghost by correcting the weight ω[F] calculated by the weight calculator 23.

An estimated shape C[F] specified based on the product of the amplitude spectrum S and a spectral distribution ratio Q[F] generated from a tone model M[F], which dominantly supports (or contributes to) the harmonic structure of the amplitude spectrum S, includes peaks at the same frequencies x as those of the tone model M[F] since the tone model M[F] includes peaks at the same frequencies x as those of the amplitude spectrum S. Accordingly, aspects (such as frequencies or amplitudes of peaks) of the tone model M[F] are similar to those of the estimated shape C[F], as can be seen from the tone model M[200] of FIG. 2(*b*) and the estimated shape C[200] of FIG. 2(*d*). On the contrary, an estimated shape C[F] specified from a tone model M[F], which deviates from the harmonic structure of the amplitude spectrum S, has a form with some peaks of the tone model M[F] reduced since the tone model M[F] includes peaks at different frequencies x from those of the amplitude spectrum S. Accordingly, aspects of the tone model M[F] are significantly different from those of the estimated shape C[F], as can be seen from the tone model M[100] of FIG. 2(*b*) and the estimated shape C[100] of FIG. 2(*d*). In this embodiment, taking into consideration these characteristics, the weight ω[F] of a fundamental frequency F with low similarity between a tone model M[F] and an estimated shape C[F] corresponding to the fundamental frequency F is recognized as a ghost and is forcibly reduced.

As shown in FIG. 1, the ghost suppressor 27 includes a similarity analyzer 271, a weight corrector 273, and a normalizer 275. The similarity analyzer 271 is means for calculating a value (hereinafter referred to as a "similarity index value") R[F] for each fundamental frequency F indicating whether or not a tone model M[L] and an estimated shape C[F] corresponding to the same fundamental frequency F are similar. The similarity index value R[F] in this embodiment is a Kullback-Leibler (KL) information quantity. Accordingly, the similarity index value R[F] approaches zero as the similarity between the tone model M[F] and the estimated shape C[F] increases (and the similarity index value R[F] increases as the difference between them increases).

Figure 3:
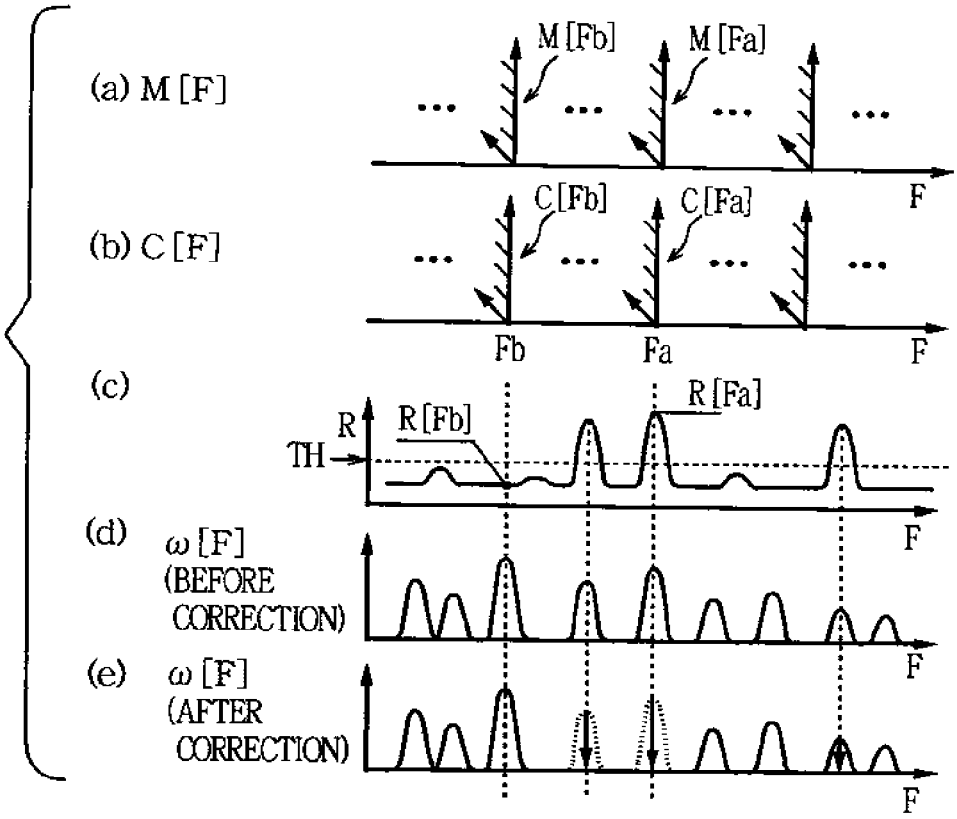
FIG. 3 is a conceptual diagram illustrating details of a process performed by a ghost suppressor.

FIG. 3 is conceptual diagrams illustrating processes performed by the ghost suppressor 27. FIG. 3(*a*) illustrates tone models M[F] stored in the storage 30 and FIG. 3(*b*) illustrates estimated shapes C[F] specified by the estimated shape specifier 21. FIG. 3(*c*) illustrates a similarity index value R[F] calculated by the similarity analyzer 271. As shown in FIG. 3, a similarity index value R[Fa] corresponding to a fundamental frequency Fa is high since the difference between a tone model M[Fa] and an estimated shape C[Fa] corresponding to the fundamental frequency Fa is great (i.e., since the tone model M[Fa] deviates from the harmonic structure of the amplitude spectrum S). On the other hand, a similarity index value R[Fb] corresponding to a fundamental frequency Fb is low since the similarity between a tone model M[Fb] and an estimated shape C[Fb] corresponding to the fundamental frequency Fb is high (i.e., since the tone model M[Fb] dominantly supports the harmonic structure of the amplitude spectrum S).

The weight corrector 273 forcibly changes a weight ω[F] of a fundamental frequency F, whose tone model M[F] and estimated shape C[F] are not similar (i.e., have low similarity), to zero regardless of its value calculated by the weight calculator 23. More specifically, the weight corrector 273 of this embodiment maintains the weight ω[F] calculated by the weight calculator 23 when the similarity index value R[F] is less than a threshold TH and changes, to zero, the weight ω[F] when the similarity index value R[F] is greater than the threshold TH. FIG. 3(*d*) illustrates a distribution of weights ω[F] calculated by the weight calculator 23 and FIG. 3(*e*) illustrates a distribution of the weights ω[F] corrected by the weight corrector 273. As shown in FIGS. 3(*d*) and 3(*e*), weights ω[F] distributed near the fundamental frequency Fb are maintained since the similarity index value R[Fb] of the fundamental frequency Fb is less than the threshold TH. On the contrary, weights ω[F] distributed near the fundamental frequency Fa are removed since the similarity index value R[Fa] of the fundamental frequency Fa is greater than the threshold TH.

If the weights ω[F] are corrected as described above, the sum of the weights ω[F] of all fundamental frequencies F may not be 1. Thus, the normalizer 275 of FIG. 1 normalizes the weights ω[F] corrected by the weight corrector 273 such that the sum (integral) of the weights ω[F] output from the ghost suppressor 27 to the estimated shape specifier 21 over all fundamental frequencies F is 1 and outputs the normalized weights ω[F] to the estimated shape specifier 21.

The pitch specifier 40 of FIG. 1 is means for specifying fundamental frequencies F0 (pitches) of a plurality of sounds included in a target sound based on a fundamental frequency probability density function P. The pitch specifier 40 of this embodiment specifies the courses of the fundamental frequencies F0 of the desired sounds by specifying temporal changes of a plurality of peaks appearing in the probability density function P through a multi-agent model. More specifically, the pitch specifier 40 assigns the individual peaks of the probability density function P respectively to a plurality of autonomous agents and causes the agents to track temporal changes of the peaks. The pitch specifier 40 then outputs, as the fundamental frequencies F0, the frequencies of peaks of a predetermined number of agents that are selected from the plurality of agents in order of decreasing reliability. Details of the behavior of each agent are described in Japanese Patent Registration No. 3413634. The details of the behavior of each agent are also described in a paper entitled "A real-time music-scene-description system: predominant-F0 estimation for detecting melody and bass lines in real-world audio signals", Masataka Goto, Speech Communication 43 (2004) 311-329. All of the contents of this paper are incorporated into the specification by referencing.

Figure 4:
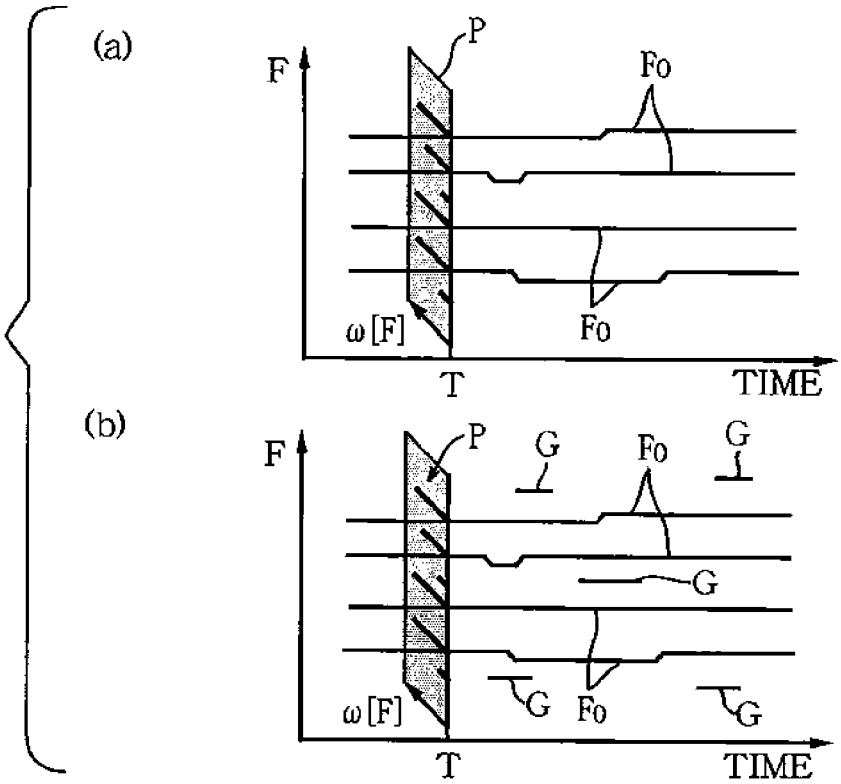
FIG. 4 is graphs illustrating the effects of suppression of ghosts.

As described above, in this embodiment, an estimated shape C[F] corresponding to a fundamental frequency F of a sound, which is not actually included in the target sound, and a weight ω[F] and a value k[F] generated based on the estimated shape C[F] are effectively reduced, compared to a configuration without the ghost suppressor 27 (which will be referred to as a "comparison example"), since the weight ω[F] corrected by the ghost suppressor 27 is used to specify the estimated shape C[F]. FIG. 4 is pattern diagrams showing temporal changes of fundamental frequencies F0 specified by the pitch specifier 40. A probability density function P at time T is also illustrated in each of FIGS. 4(*a*) and 4(*b*). FIG. 4(*a*) illustrates the courses of fundamental frequencies F0 specified by the pitch specifier 40 of this embodiment and FIG. 4(*b*) illustrates the courses of fundamental frequencies F0 specified in the configuration of the comparison example. This embodiment removes ghosts G present in FIG. 4(*b*) as shown in FIG. 4(*a*). That is, only the fundamental frequencies F0 of sounds that are actually included in the target sound can be clearly extracted with high accuracy according to this embodiment.

When only one fundamental frequency F0 is estimated from a fundamental frequency probability density function P as described in Japanese Patent Registration No. 3413634, it is likely that the fundamental frequency F0 of the desired sound can be estimated by searching for the most prominent peak in the probability density function P even in the case of the comparison example where ghosts are present in the weight ω[F]. However, using the most prominent peak search method, it is difficult to accurately extract the fundamental frequencies F0 of a plurality of sounds from a probability density function P having ghosts G and peaks corresponding to the desired fundamental frequencies F0. This embodiment suppresses weights ω[F] corresponding to ghosts G to selectively make only the peaks of sounds, which are actually included in the target sound, apparent in the probability density function P. Thus, it is possible to accurately and easily specify the fundamental frequencies F0 of a plurality of sounds by selecting a predetermined number of peaks (agents), for example in order of decreasing weight ω[F].

MODIFIED EMBODIMENTS

The above embodiments may be modified in various ways. The following illustrates specific modified embodiments. Appropriate combinations of the following embodiments are also possible.

(1) Modified Embodiment 1

Although the weight ω[F] initially calculated for one frame is corrected at the weight corrector 273 in the configurations illustrated in the above embodiments, the timing when the weight ω[F] is corrected is optional. For example, it is also possible to provide configurations in which the weight ω[F] is corrected after a unit process is performed a predetermined number of times (one or more times). However, the configurations, in which the weight ω[F] is corrected at an initial stage as in the above embodiments, have an advantage of reducing the time (or the number of repetitions of the unit process) required to optimize the weight ω[F]. The number of times the correction of the weight ω[F] is performed on one frame is also optional. For example, configurations, in which the weight ω[F] is corrected each time the unit process is performed a predetermined number of times (one or more times), are also employed.

(2) Modified Embodiment 2

Although the similarity index value R[F] is compared with the threshold TH in the configurations illustrated in the above embodiments, the method of determining whether or not to correct the weight ω[F] is changed appropriately. For example, the weights ω[F] of a predetermined number of fundamental frequencies F selected in order of increasing similarity between the tone model M[F] and the estimated shape C[F] (in order of decreasing similarity index value R[F]) may be corrected to zero.

In addition, although weights ω[F] corresponding to ghosts are changed to zero in the configurations illustrated in the above embodiments, the method of correcting the weights ω[F] is not limited to it. That is, weights corresponding to ghosts, among weights ω[F] output from the ghost suppressor 27 to the estimated shape specifier 21, only needs to be reduced to values less than the weights ω[F] calculated by the weight calculator 23. Accordingly, in addition to the means for replacing weights ω[F] corresponding to ghosts with zero, means for multiplying weights ω[F] corresponding to ghosts by a value less than 1 or means for subtracting a predetermined value from the weights ω[F] may also be employed as the weight corrector 273.

Further, although weights ω[F] corresponding to ghosts are suppressed in the configurations illustrated in the above embodiments, a configuration, in which weights ω[F] of fundamental frequencies F at which no ghost occurs are increased to values greater than the weights ω[F] calculated by the weight calculator 23, is also employed. For example, the weight corrector 273 maintains weights ω[F] of fundamental frequencies F, whose similarity index value R[F] is greater than the threshold TH, at the weights ω[F] calculated by the weight calculator 23 and corrects weights ω[F] of fundamental frequencies F, whose similarity index value R[F] is less than the threshold TH (i.e., whose tone model M[F] and estimated shape C[F] are similar), to values greater than the weights ω[F] calculated by the weight calculator 23 and outputs the values as the corrected weights ω[F] of the fundamental frequencies F. Means for multiplying weights ω[F] corresponding to ghosts by a predetermined value greater than 1 or means for adding a predetermined value to the weights ω[F] is also employed as the weight corrector 273 in this configuration.

(3) Modified Embodiment 3

The KL information quantity is just an example of the similarity index value R[F]. For example, a Root Means Square (RMS) error between the tone model M[F] and the estimated shape C[F] may also be calculated as the similarity index value R[F]. In addition, although the similarity index value R[F] approaches zero as the similarity between the tone model M[F] and the estimated shape C[F] increases in the cases illustrated above, the similarity index value R[F] may be calculated such that the similarity index value R[F] approaches zero as the similarity between the tone model M[F] and the estimated shape C[F] decreases. That is, in the present invention, the method of calculating the similarity index value R[F] is optional and any configuration suffices if it reduces weights ω[F] of fundamental frequencies F whose tone model M[F] and estimated shape C[F] have low similarity.

(4) Modified Embodiment 4

Although a predetermined number of peaks selected in order of decreasing weight ω[F] in the fundamental frequency probability density function P are extracted as fundamental frequencies F0 in the configurations illustrated in the above embodiments, configurations, in which peaks higher than a predetermined threshold among a plurality of peaks of the probability density function P are extracted as fundamental frequencies F0, may also be employed. In addition, although a plurality of fundamental frequencies F0 are estimated in the configurations illustrated in the above embodiments, the above embodiments may of course be applied when one fundamental frequency F0 is estimated.

(5) Modified Embodiment 5

Figure 5:
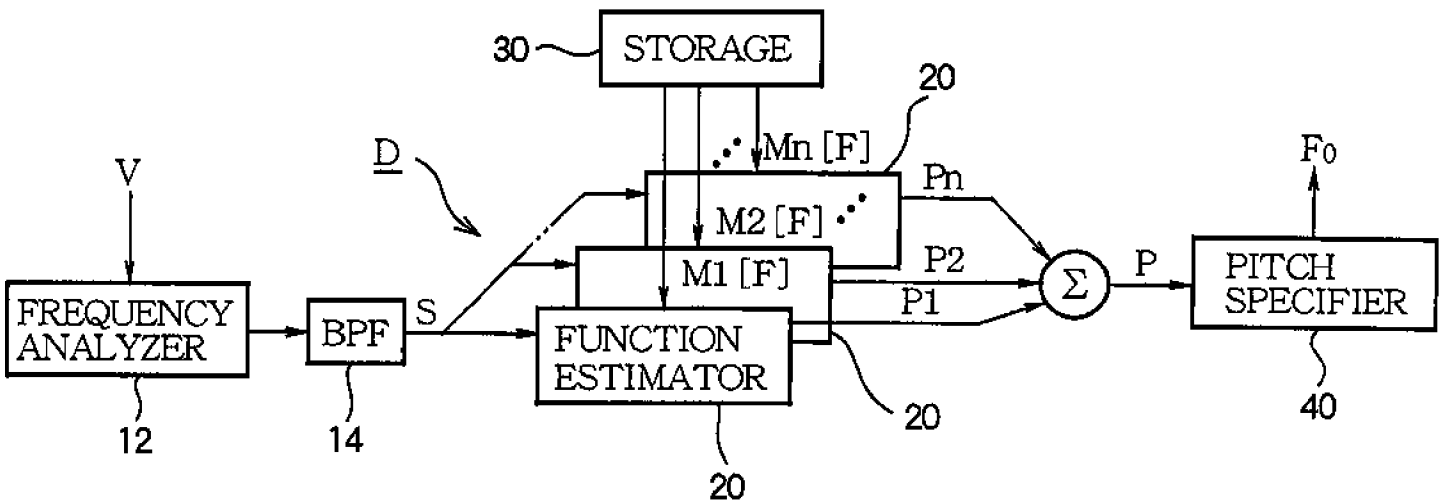
FIG. 5 is a functional block diagram illustrating a pitch estimation apparatus according to a modified embodiment.

Although a set of tone models M[F] is used in the configurations illustrated in the above embodiments, a plurality of sets of tone models M[F] may also be used as shown in FIG. 5. A pitch estimation apparatus D of FIG. 5 includes n function estimators 20, where "n" is a positive integer greater than 1. A storage 30 stores n sets of tone models M1[F] to Mn[F] corresponding respectively to the n function estimators 20. Similar to the tone models M[F] of FIGS. 1 to 3, a set of tone models Mi[F] corresponding to an ith function estimator 20, where "i" is an integer such that $1 \leq i \leq n$, is a function which models a harmonic structure corresponding to each fundamental frequency F. The tone models M1[F] to Mn[F] have different aspects such as frequencies or amplitudes of peaks. For example, in a pitch estimation apparatus D used to estimate the fundamental frequency of each string sound from a sound played with a string instrument having a plurality of strings (for example, a 6-string guitar), tone models Mi[F] are created such that they correspond to acoustic characteristics of sounds played with an ith string.

An amplitude spectrum S output from a BPF 14 is divided into n sets, which are then provided respectively to the function estimators 20. Each function estimator 20 performs, in parallel with each other, the same unit process (including an estimated shape specification process and a weight calculation process) as that of the above embodiment based on the amplitude spectrum S and a tone model Mi[F], corresponding to the function estimator 20, stored in the storage 30. As shown in FIG. 5, the sum of probability density functions P1 to Pn is output as a fundamental frequency probability density function P to the pitch specifier 40. Since it uses a plurality of sets of tone models M1[F] to Mn[F], this configuration can more accurately estimate fundamental frequencies of a plurality of sounds included in a target sound, compared to the configuration of FIG. 1 which uses only one set of tone models M[F].

(6) Modified Embodiment 6

In configurations in which a weight ω[F] is separately calculated for each frame of an audio signal V as in the above embodiments, an estimated shape C[F] is calculated, for example by multiplying the amplitude spectrum S by the tone model M[F] (or the spectral distribution ratio Q[F]), when the first estimated shape specification process is performed on one frame. However, a weight ω[F] of each frame may also be calculated using, as an initial value, a weight ω[F] finally determined for an immediately previous frame (i.e., a function value of a probability density function P estimated for the immediately previous frame). For example, when the first estimated shape specification process is performed on one frame, an estimated shape C[F] may also be calculated by multiplying the amplitude spectrum S by a spectral distribution ratio Q[F] generated from both a tone model M[F] and a weight ω[F] finally calculated for an immediately previous frame.

Figure 6:
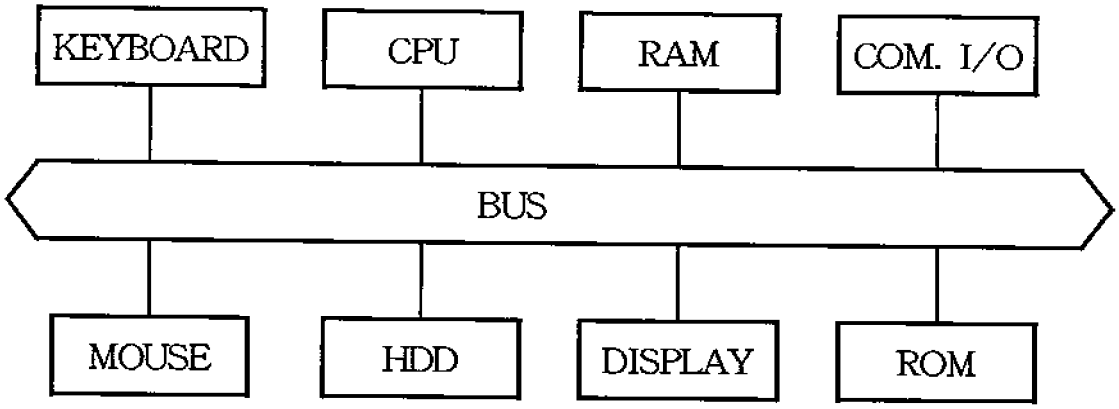
FIG. 6 is a block diagram showing a hardware construction of the pitch estimation apparatus in the form of a personal computer.

FIG. 6 is a block diagram showing a hardware structure of the pitch estimation apparatus constructed according to the invention. The inventive pitch estimation apparatus is based on a personal computer composed of CPU, RAM, ROM, HDD (Hard Disk Drive), Keyboard, Mouse, Display and COM I/O (communication input/output interface).

A pitch estimation program is installed and executed on the personal computer that has audio signal acquisition functions such as a communication function to acquire musical audio signals from a network through COM I/O. Otherwise, the personal computer may be equipped with a sound collection function to obtain input audio signals from nature, or a player function to reproduce musical audio signals from a recording medium such as HDD or CD. The computer, which executes the pitch estimation program according to this embodiment, functions as a pitch estimation apparatus according to the invention.

A machine readable medium such as HDD or ROM is provided for use in a computer for estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models. The machine readable medium contains program instructions executable by the computer for performing: a function estimation process of estimating the fundamental frequency probability density function by repeating a weight calculation process and an estimated shape specification process, wherein the weight calculation process calculates a weight of each tone model of each fundamental frequency based on an estimated shape of each tone model of each fundamental frequency, the estimated shape indicating a degree of dominancy of a corresponding tone model in a total harmonic structure of the audio signal, and the estimated shape specification process specifies each estimated shape of each tone model of each fundamental frequency based on an amplitude spectrum of the audio signal, the harmonic structure of each tone model of each fundamental frequency, and the weight of each tone model of each fundamental frequency; a similarity analysis process of calculating a similarity index value indicating a degree of similarity between each tone model of each fundamental frequency and each estimated shape specified from the corresponding tone model in the estimated shape specification process; and a weight correction process of reducing a weight of at least one tone model of a certain fundamental frequency having the similarity index value indicating that the one tone model and the corresponding estimated shape are not similar to each other, among the weights of the plurality of the tone models calculated in the weight calculation process.

What is claimed is:

1. A pitch estimation apparatus for estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models, the pitch estimation apparatus comprising:

a plurality of function estimators, each being provided with the audio signal, and each estimating the fundamental frequency probability density function by repeating a weight calculation process and an estimated shape specification process, wherein the weight calculation process calculates a weight of each tone model of each fundamental frequency based on an estimated shape of each tone model of each fundamental frequency, the estimated shape indicating a degree of dominancy of a corresponding tone model in a total harmonic structure of the audio signal, and the estimated shape specification process specifies each estimated shape of each tone model of each fundamental frequency based on an amplitude spectrum of the audio signal, the harmonic structure of each tone model of each fundamental frequency, and the weight of each tone model of each fundamental frequency;

wherein each function estimator comprises:

a similarity analysis part that calculates a similarity index value indicating a degree of similarity between each tone model of each fundamental frequency and each estimated shape specified from the corresponding tone model by the estimated shape specification process; and a weight correction part that reduces a weight of at least one tone model of a certain fundamental frequency having the similarity index value indicating that said one tone model and the corresponding estimated shape are not similar to each other, relative to weights of other tone models having similarity index values indicating that these tone models and corresponding estimated shapes are similar, the pitch estimation apparatus further comprising:

a pitch specifying part that receives a sum of the fundamental frequency probability density functions outputted from the plurality of the function estimators and that specifies, as one or more pitches of the audio signal, one or more of the fundamental frequencies corresponding to salient peaks appearing in the sum of the fundamental frequency probability density functions.

2. The pitch estimation apparatus according to claim 1, wherein the weight correction part changes the weight of said one tone model of the certain fundamental frequency to zero, said one tone model of the certain fundamental frequency having the similarity index value indicating that said one tone model and the corresponding estimated shape are not similar to each other.

3. The pitch estimation apparatus according to claim 1, wherein the function estimator executes the estimated shape specification process to generate the estimated shape of the corresponding tone model of the respective fundamental frequency based on a product of the amplitude spectrum of the audio signal, the harmonic structure of the corresponding tone model, and the weight calculated for the corresponding tone model of the respective fundamental frequency.

4. A pitch estimation method of estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models, the pitch estimation method comprising:

performing a plurality of function estimating processes in parallel to each other, each function estimating process estimating the fundamental frequency probability density function by repeating a weight calculation process and an estimated shape specification process, wherein the weight calculation process calculates a weight of each tone model of each fundamental frequency based on an estimated shape of each tone model of each fundamental frequency, the estimated shape indicating a degree of dominancy of a corresponding tone model in a total harmonic structure of the audio signal, and the estimated shape specification process specifies each estimated shape of each tone model of each fundamental frequency based on an amplitude spectrum of the audio signal, the harmonic structure of each tone model of each fundamental frequency, and the weight of each tone model of each fundamental frequency, wherein each function estimating process comprises:

calculating a similarity index value indicating a degree of similarity between each tone model of each fundamental frequency and each estimated shape specified from the corresponding tone model by the estimated shape specification process; and reducing a weight of at least one tone model of a certain fundamental frequency having the similarity index value indicating that said one tone model and the corresponding estimated shape are not similar to each other, relative to weights of other tone models having similarity index values indicating that these tone models and corresponding estimated shapes are similar, the pitch estimation method further comprising:

summing the fundamental frequency probability density functions estimated by the plurality of the function estimating processes; and specifying as, one or more pitches of the audio signal, one or more of the fundamental frequencies corresponding to salient peaks appearing in the sum of the fundamental frequency probability density functions.

5. A non-transitory machine readable medium for use in a computer for estimating a fundamental frequency of an audio signal from a fundamental frequency probability density function by modeling the audio signal as a weighted mixture of a plurality of tone models corresponding respectively to harmonic structures of individual fundamental frequencies, so that the fundamental frequency probability density function of the audio signal is given as a distribution of respective weights of the plurality of the tone models, the machine readable medium containing program instructions being executable by the computer for performing:

a plurality of function estimating processes in parallel to each other, each function estimation process of estimating the fundamental frequency probability density function by repeating a weight calculation process and an estimated shape specification process, wherein the weight calculation process calculates a weight of each tone model of each fundamental frequency based on an estimated shape of each tone model of each fundamental frequency, the estimated shape indicating a degree of dominancy of a corresponding tone model in a total harmonic structure of the audio signal, and the estimated shape specification process specifies each estimated shape of each tone model of each fundamental frequency based on an amplitude spectrum of the audio signal, the harmonic structure of each tone model of each fundamental frequency, and the weight of each tone model of each fundamental frequency, wherein each function estimating process comprises:

a similarity analysis process of calculating a similarity index value indicating a degree of similarity between each tone model of each fundamental frequency and each estimated shape specified from the corresponding tone model by the estimated shape specification process; and a weight correction process of reducing a weight of at least one tone model of a certain fundamental frequency having the similarity index value indicating that said one tone model and the corresponding estimated shape are not similar to each other, relative to weights of other tone models having similarity index values indicating that these tone models and corresponding estimated shapes are similar;

the machine readable medium containing program instructions being executable by the computer for further performing:

a summing process of summing the fundamental frequency probability density functions estimated by the plurality of the function estimating processes; and a pitch specifying process of specifying, as one or more pitches of the audio signal, one or more of the fundamental frequencies corresponding to salient peaks appearing in the sum of the fundamental frequency probability density functions.

* * * * *